US010250015B2

(12) United States Patent
Benz et al.

(10) Patent No.: US 10,250,015 B2
(45) Date of Patent: Apr. 2, 2019

(54) SPARK PLUGS HAVING A CENTER ELECTRODE

(71) Applicant: Robert Bosch GmbH, Stuttgart (DE)

(72) Inventors: Andreas Benz, Bamberg (DE); Manfred Roeckelein, Kemmern (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/536,000

(22) PCT Filed: Dec. 3, 2015

(86) PCT No.: PCT/EP2015/078538

§ 371 (c)(1),
(2) Date: Jun. 14, 2017

(87) PCT Pub. No.: WO2016/096462

PCT Pub. Date: Jun. 23, 2016

(65) Prior Publication Data

US 2017/0346260 A1 Nov. 30, 2017

(30) Foreign Application Priority Data

Dec. 16, 2014 (DE) ..... 10 2014 226 107

(51) Int. Cl.
*H01T 13/39* (2006.01)
*H01T 13/16* (2006.01)
(Continued)

(52) U.S. Cl.
CPC ..... *H01T 13/39* (2013.01); *H01T 13/16* (2013.01); *H01T 13/20* (2013.01); *H01T 13/32* (2013.01)

(58) Field of Classification Search
None
See application file for complete search history.

(56) References Cited

U.S. PATENT DOCUMENTS 3,753,795 A * 8/1973 Weber ..... C22C 32/0026 148/410
6,528,929 B1 3/2003 Matsutani et al.
(Continued)

FOREIGN PATENT DOCUMENTS

DE 19854861 A1 5/2000
DE 102004044152 A1 4/2005
(Continued)

OTHER PUBLICATIONS

International Search Report dated Feb. 22, 2016, of the corresponding International Application PCT/EP2015/078538 filed Dec. 3, 2015.

*Primary Examiner* — Nimeshkumar Patel
*Assistant Examiner* — Jacob R Stern
(74) *Attorney, Agent, or Firm* — Norton Rose Fulbright US LLP; Gerard Messina

(57) ABSTRACT

A spark plug having a housing, an insulator situated in the housing, a center electrode situated in the insulator and a ground electrode situated on the housing, the ground electrode and the center electrode being situated toward each other in such a way that the ground electrode and the center electrode form a spark gap, and the center electrode rest with a center electrode head on a seat developed on an inner side of the insulator, and the center electrode having an electrode base body and a core situated in the electrode base body, the core being made from a material that has a higher heat conductivity than the material of the electrode base body, the electrode base body having a diameter that is not greater than 1.7 mm.

11 Claims, 3 Drawing Sheets

(51) Int. Cl.
*H01T 13/20* (2006.01)
*H01T 13/32* (2006.01)

(56) References Cited

U.S. PATENT DOCUMENTS

| | | | |
|---|---|---|---|
| 2005/0117052 | A1 | 6/2005 | Willes et al. |
| 2009/0127998 | A1 | 5/2009 | Kyuno et al. |
| 2009/0189502 | A1 | 7/2009 | Suzuki et al. |
| 2014/0111079 | A1 | 4/2014 | Kato |

FOREIGN PATENT DOCUMENTS

| | | | |
|---|---|---|---|
| DE | 102013207714 | A1 | 10/2013 |
| DE | 102014101607 | A1 | 8/2014 |
| JP | H0343982 | A | 2/1991 |
| JP | H0737672 | A | 2/1995 |
| JP | 2000208235 | A | 7/2000 |
| JP | 2005203119 | A | 7/2005 |
| JP | 2006269441 | A | 10/2006 |
| JP | 4249161 | B2 | 4/2009 |
| JP | 2010165698 | A | 7/2010 |
| JP | 2014038773 | A | 2/2014 |

* cited by examiner

SPARK PLUGS HAVING A CENTER ELECTRODE

FIELD

The present invention relates to a spark plug.

BACKGROUND INFORMATION

Due to the increasing reduction of space in the engine compartment, less space is available in the engine compartment for the individual components such as the spark plug, for example, and the components in the engine compartment must be reduced in size. The trend of the so-called downsizing of the components presents new challenges in the construction of the components and of the spark plug.

The downsizing of the spark plug and its components increases the thermal, electrical and mechanical load on the spark plug and its individual components. At the same time, the spark plug is to have a spark-reliability of the same quality and a service life of the same length as previous spark plugs that are not subject to downsizing.

SUMMARY

An adaptation of the insulator and of the center electrode to the new requirements arising from the downsizing presents a challenge.

Due to its ceramic nature, the insulator is the more sensitive component in the spark plug in comparison to the metallic components with respect to mechanical and electrical loads.

Tests by the applicant have shown that in spark plugs having a housing, an insulator situated in the housing, a center electrode situated in the insulator and a ground electrode situated on the housing, where the mass electrode and the center electrode are situated with respect to each other in such a way that the ground electrode and the center electrode form an spark gap, and where the center electrode rests with an electrode head on a seat formed on an inner side of the insulator, and where the center electrode has an electrode base body and a core situated in the electrode base body, the core being made of a material that has a higher thermal conductivity than the material of the electrode base body, a minimum wall thickness should be maintained in order to ensure the mechanical and electrical stability of the insulator. It is necessary to achieve an optimum between the stability and dissipation of heat of the insulator on the one hand and the dissipation of heat of the spark plug as a whole as well as the service life of the spark plug on the other hand.

It is an object of the present invention to provide a spark plug that is able to fulfill the requirements described above.

This object may be achieved by the spark plug in accordance with the present invention.

Because the center electrode is designed as an electrode base body having a core made of a material that has a higher thermal conductivity than the material of the electrode base body and that the electrode base body has a diameter that is not greater than 1.7 mm, the present invention provides a spark plug that fulfills the above-mentioned requirements with this center electrode. It is possible to design the insulator with a sufficient wall thickness, which allows the spark plug to withstand the thermal, mechanical and electrical loads in operation.

The center electrode or the electrode base body may have regions of different diameters. The mentioned limits for the diameter of the electrode base body respectively refer to the greatest diameter of the electrode base body, apart from the electrode head. The electrode head is developed on the end of the center electrode facing away from the combustion chamber. In the spark plug, the electrode head rests on a seat formed on the inner side of the insulator. The electrode head extends from the seat formed on the inner side of the insulator to the end of the center electrode facing away from the combustion chamber. If the geometry of the cross section of the electrode base body deviates from the round shape, then the diameter refers to the circumference of the non-round geometry of the cross section of the electrode base body.

In one preferred development, the diameter of the electrode base body is not greater than 1.5 mm.

Additional advantageous developments are described herein.

Alternatively or additionally, there may also be a provision for the diameter of the electrode base body not to be smaller than 1 mm so that the stability of the center electrode itself is not put at risk. The electrode base body should preferably have this minimum diameter so that the cross section of the electrode base body is large enough for a sufficient dissipation of heat along the center electrode so that the insulator on its combustion chamber-side end does not have the additional load of the heat taken up by the center electrode in addition to the heat taken up from the combustion chamber. Ideally, the heat taken up from the combustion chamber within the center electrode is conducted into areas that are further removed from the combustion chamber and are thus cooler.

The housing and the center electrode are at different electrical potentials. In the area of the seat developed on the insulator, the center electrode and the housing have the least distance from one another on account of the construction. This area of the insulator is therefore very susceptible to electrical breakdowns. To prevent these electrical breakdowns on the insulator, it has proven advantageous for the insulator to have a wall thickness in the area of the seat developed on its inner side of no less than 2 mm. Additionally or alternatively, there may be a provision for the area of the insulator surrounding the electrode head to have a wall thickness of no less than 2 mm. As a result, the insulator has a sufficiently large wall thickness so as to withstand high electrical fields occurring in the area of the seat developed on the insulator and the electrical breakdowns caused thereby.

The core of the electrode base body advantageously is made of a material that has a higher heat conductivity than the material of the electrode base body. This promotes the heat conduction within the electrode base body. The material of the core preferably has a heat conductivity of at least 350 W/mK at room temperature. Additionally or alternatively, there may be a provision for the heat conductivity of the material of the core at room temperature to be greater by at least 300 W/mK than the head conductivity of the material of the electrode base body.

The electrode base body features an alloy containing nickel for example. The alloy preferably contains at least 20% by weight chromium, in particular at least 25% by weight chromium. In an alternative nickel alloy, the alloy contains alternatively or additionally yttrium. The core is made of copper or silver, for example, or of an alloy including copper and/or silver. Tests performed by the applicant have shown that a copper-containing core in the electrode base body, for example, reduces the temperature on the end of the electrode base body facing the combustion chamber by 50K to 80K.

Further tests by the applicant showed that for a sufficient dissipation of heat, i.e., a reduction of heat within the center electrode, the cross-sectional area of the core is not smaller than 20% of the cross-sectional area of the electrode base body or of the center electrode in at least one first area, the electrode base body and the core respectively having a constant diameter in the at least one first area. The cross-sectional area of the electrode base body is composed of the cross-sectional area of the core and the cross-sectional area of the jacket.

The at least one first area is preferably cylindrical. The at least one first area preferably has a length along the longitudinal axis of the center electrode that is equal to or longer than the diameter of the electrode base body in this first area, in particular the length of the at least one first area is at least 1.5 times as long as the diameter of the electrode base body.

Additionally or alternatively, there may be a provision for the cross-sectional area of the core to correspond maximally to 65% of the total cross-sectional area of the electrode base body or of the center electrode. This ensures that the center electrode has a sufficiently great wall thickness.

Advantageously, the electrode base body is made up of a more wear-resistant material than the core such that the electrode base body preferably must have a minimum jacket thickness for the center electrode to have a sufficiently long service life, for example at least 50,000 km.

It has proven to be advantageous if the electrode base body has a minimum jacket thickness that is not less than 0.15 mm, in particular not less than 0.25 mm. Additionally or alternatively, there may be a provision for the jacket thickness in the at least one first area having constant diameters of the core and the electrode base body to be no greater than 0.35 mm.

In a preferred development of the present invention, the center electrode has on its combustion chamber-side face a noble metal-containing ignition surface that has a higher wear-resistance than the electrode base body material. The distance b from the ignition surface to the core has a value in the range from 0.2 mm to 2 mm.

In one alternative development of the present invention, the center electrode has no ignition surface. In this case, the distance b from the combustion chamber-side face of the electrode base body to the combustion chamber-side end of the core is at least 0.6 mm so as to ensure a sufficiently long service life of the center electrode. The distance b preferably has a value that is not smaller than 1 mm, and in particular not greater than 3.5 mm.

Advantageously it is provided for the cross-sectional area of the core and the cross-sectional area of the electrode base body to have the same geometric shape, in particular the core within a cross-sectional plane being situated at the center in the electrode base body. This ensures that the electrode base body within the cross-sectional plane has a uniform jacket thickness.

Spark plugs having a reduced outer diameter of the housing in the sense of the present invention are spark plugs whose screw threads have an outer diameter of less than 14 mm, for example so-called M12 or M10 spark plugs.

DETAILED DESCRIPTION OF EXAMPLE EMBODIMENTS

Figure 1:
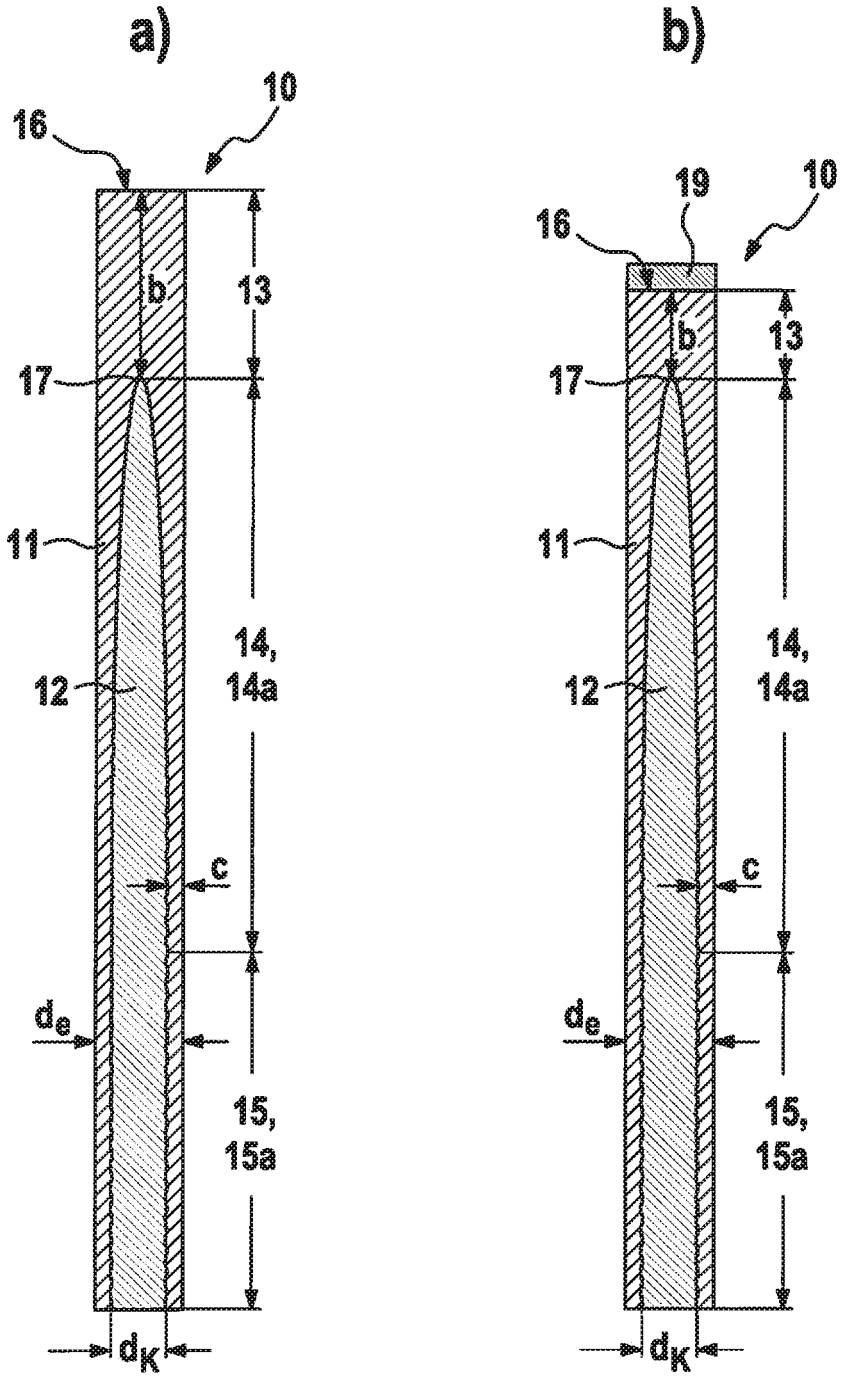
FIG. 1 shows two examples of a center electrode.

FIG. 1 shows schematic representations of two exemplary specific embodiments of center electrode 10. Center electrode 10 has an electrode base body 11 and a core 12, which is situated within electrode base body 12. Core 11 is made of a material that has a higher heat conductivity than the material of electrode base body 11. Typically, the material of electrode base body 11 has a higher wear resistance than the material of core 12. Core 12 is made of copper, silver including copper and/or silver. An Ni alloy is preferably used as the material for electrode base body 11, it being possible for the alloy to contain chromium and/or yttrium.

Due to the manufacturing process, in this case an extrusion process, the core of the center electrode 10 shown here in a sectional view has at least one first segment 15*a*, in which core 12 has a relatively constant diameter $d_K$. The term "relatively constant" in the sense of this application means that the diameter $d_K$ in the section changes its value at a maximum by 5%.

Within a second section 14*a*, the diameter $d_K$ of core 12 is reduced. The at least one first section 15*a* is situated on a side of center electrode 10 facing away from the combustion chamber, an electrode head 4, not shown here, being developed subsequent to the end of first section 15 facing away from the combustion chamber. The second section 14*a* follows upon the at least one first section 15*a* in the direction of the combustion chamber. Fundamentally, it is conceivable that core 12 has several first sections 15*a* having constant diameters $d_K$, the diameters $d_K$ of the individual first sections 15*a* being different. This is the case, in particular, if the center electrode 10 or the electrode base body 11 itself has several areas having different $d_E$ diameters. In the case of several first sections 15*a* of the core, the section closest to the combustion chamber is the second section 14*a* with the continuously decreasing diameter $d_K$ of core 12.

The center electrode 10 represented in FIG. 1 is made up of an electrode base body 11, which has along its length a constant diameter $d_E$, and thus center electrode 10 also has a constant diameter $d_E$. In the case of electrode base body 11, it is possible to distinguish at least three areas 13, 14, 15. In a first area 15, electrode base body 11 has a core 12 having a constant diameter $d_K$. In a second area 14*a*, electrode base body 11 has a core 12 having a continuously decreasing diameter $d_K$. In a third area 13, electrode base body 11 has no core.

The thickness c of the jacket of electrode base body 11 results from half of the difference of the electrode base body diameter $d_E$ with respect to the core diameter $d_K$. If the electrode base body 11 in the first area 15 has a constant diameter $d_{E1}$, then the jacket thickness c in this first area 15 is constant. Advantageously, there is a provision that in this first area 15 the jacket thickness c of the electrode base body 11 is not less than 0.15 mm and not greater than 0.35 mm, for example the jacket thickness c is equal to 0.25 mm or less.

In second area 14, the electrode base body 11 may have a constant diameter $d_{E2}$, the jacket thickness c in this case increasing within the area 14 in the direction of the combustion chamber. The jacket thickness c is at least 0.15 mm in the area 14.

In an alternative specific embodiment, not shown here, the diameter $d_{E2}$ of electrode base body 11 in the second area 14 may likewise decrease. In this case, jacket thickness c is preferably in the range from 0.15 mm to 0.35 mm. There may be a provision for diameter $d_{E2}$ of electrode base body 11 to change at the same rate as diameter $d_K$ of core 12. This has the advantage that the jacket thickness c in second area 14 remains constant.

In third area 13 of electrode base body 11, there is no core and thus jacket thickness c corresponds to half the diameter $d_{E3}$ of electrode base body 11. Third area 13 preferably has a constant diameter $d_{E3}$, which corresponds to the diameter $d_{E2}$ of the second area 14 in the transition to the third area 13.

The third area 13 of the electrode base body 11 has a length b, which extends from a combustion chamber-side end 17 of core 12 to a combustion chamber-side face 16 of electrode base body 11. The length b is no greater than 3.5 mm. If center electrode 10 is developed with a noble metal-containing ignition surface 19, the length b may be developed to be shorter than without noble metal-containing ignition surface 19, as shown in FIG. 1*b*. If there is no noble metal-containing ignition surface 19, as shown in FIG. 1*a*, then the length b should have a minimum length of 0.6 mm so that noble metal base body 12 has enough material for a sufficiently long service life of center electrode 10. When using a noble metal-containing ignition surface 19, a length b of at least 0.2 mm suffices for a sufficiently long service life of center electrode 10.

Figure 2:
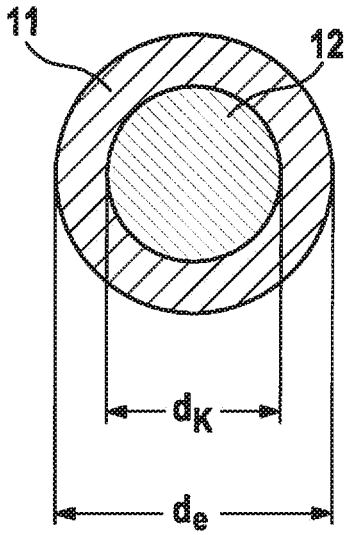
FIG. 2 shows a cross section of the center electrode.

FIG. 2 shows an example of a cross section of center electrode 10. The diameter $d_E$ of center electrode 10 of electrode base body 11 is less than 1.7 mm. The cross section of core 12 is situated at the center in the cross section of center electrode 10 or of electrode base body 11. The thickness c of the sleeve of electrode base body 11 results from half of the difference of the electrode base body diameter $d_E$ with respect to the core diameter $d_K$. Advantageously, the cross section of electrode base body 11 and of core 12 have the same geometric shape.

Figure 3:
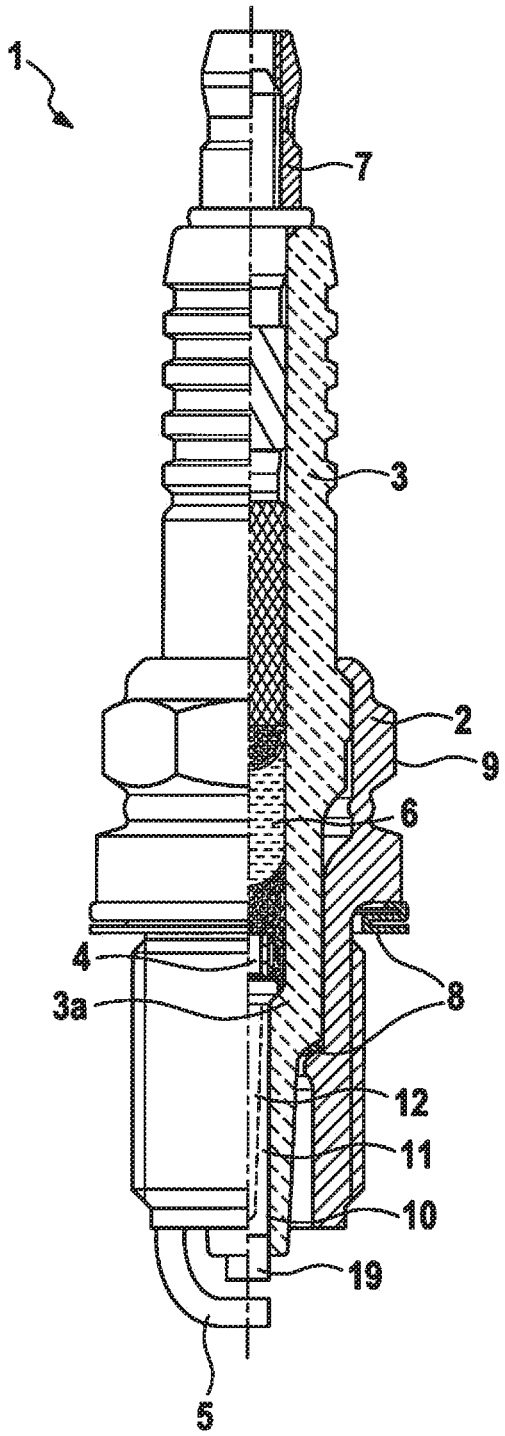
FIG. 3 shows a spark plug of the present invention having a center electrode.

FIG. 3 shows a schematic representation of a spark plug 1 having a center electrode 10 according to the present invention. Spark plug 1 has a metallic housing 2 having a screw thread for installing spark plug 1 in a cylinder head. The housing furthermore has a hex bolt section 9, on which a tool for installing spark plug 1 in cylinder head is applied. Within housing 2, an insulator 3 is situated. A center electrode 10 and a connecting bolt 7 are situated within insulator 3 and are connected electrically via a resistor element 6.

On the inner side of insulator 3, a seat (3*a*) is developed, on which center electrode (10) rests with its center electrode head (4). In the area of seat (3*a*), insulator (3) has a wall thickness of not less than 2 mm.

On the combustion chamber-side end of spark plug 1, center electrode 10 typically protrudes from insulator 3. The center electrode has a base body 10 and an ignition surface 19 situated on the combustion chamber-side end of the base body. Base body 10 has a core 12 that is surrounded by a jacket 11.

A ground electrode 5 is situated on the combustion chamber-side end of housing 2, which together with center electrode 10 forms a spark gap. Ground electrode 5 may be developed as a top electrode, a side electrode or a bow electrode.

What is claimed is:

1. A spark plug, comprising:

a housing;

an insulator situated in the housing;

a center electrode situated in the insulator; and a ground electrode situated on the housing;

wherein the ground electrode and the center electrode are situated with respect to each other in such a way that the ground electrode and the center electrode form a spark gap, the center electrode rests with an electrode head on a seat developed on an inner side of insulator, and the center electrode has an electrode base body and a core situated in the electrode base body, the core being made of a material that has a higher heat conductivity than a material of the electrode base body, and wherein the electrode base body has a diameter that is not greater than 1.7 mm, wherein the center electrode has:

at least one first area, in which the electrode base body and the core respectively have a constant diameter; and at least one second area, in which the diameter of the core is continuously reduced.

2. The spark plug as recited in claim 1, wherein the insulator has in the area of the seat developed on its inner side a wall thickness of not smaller than 2 mm.

3. The spark plug as recited in claim 1, wherein in the at least one first area, a cross-sectional area of the core corresponds at least to 20% of an entire cross-sectional area of the electrode.

4. The spark plug as recited in claim 1, wherein in the at least one first area, a cross-sectional area of the core corresponds at maximum to 65% of an entire cross-sectional area of the electrode.

5. The spark plug as recited in claim 1, wherein the electrode base body has a jacket thickness of at least 0.15 mm in the at least one first area.

6. The spark plug as recited in claim 5, wherein the jacket thickness maximally 0.35 mm.

7. The spark plug as recited in claim 1, wherein on a combustion chamber-side end of the electrode base body, a distance between an end of the electrode base body and an end of the core facing the combustion chamber is not greater than 3.5 mm.

8. The spark plug as recited in claim 7, wherein the distance is not smaller than 0.2 mm.

9. The spark plug as recited in claim 1, wherein the at least one first area is longer than the diameter of the electrode base body.

10. The spark plug as recited in claim 1, wherein a cross-sectional area of the core and a cross-sectional area of the electrode base body have the same shape.

11. The spark plug as recited in claim 1, wherein the electrode base body includes a nickel-containing alloy, and the alloy has at least 20% by weight chromium.

* * * * *